US010301576B2

(12) United States Patent
Hueffer et al.

(10) Patent No.: US 10,301,576 B2
(45) Date of Patent: May 28, 2019

(54) FORMULATIONS, THEIR USE AS OR FOR PRODUCING DISHWASHING DETERGENTS AND THEIR PRODUCTION

(71) Applicant: BASF SE, Ludwigshafen (DE)

(72) Inventors: Stephan Hueffer, Ludwigshafen (DE); Sophia Ebert, Mannheim (DE); Bjoern Ludolph, Ludwigshafen (DE); Christoph Mueller, Mannheim (DE); Alejandra Garcia Marcos, Ludwigshafen (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/765,149

(22) PCT Filed: Feb. 4, 2014

(86) PCT No.: PCT/EP2014/052174

§ 371 (c)(1),
(2) Date: Jul. 31, 2015

(87) PCT Pub. No.: WO2014/131585

PCT Pub. Date: Sep. 4, 2014

(65) Prior Publication Data

US 2015/0361379 A1 Dec. 17, 2015

(30) Foreign Application Priority Data

Feb. 28, 2013 (EP) ..... 13157192

(51) Int. Cl.

| | |
|---|---|
| ***C11D 3/00*** | (2006.01) |
| ***C11D 3/33*** | (2006.01) |
| ***C11D 3/37*** | (2006.01) |
| ***C11D 11/00*** | (2006.01) |

(52) U.S. Cl.

CPC ..... *C11D 3/0073* (2013.01); *C11D 3/33* (2013.01); *C11D 3/3723* (2013.01); *C11D 11/0035* (2013.01)

(58) Field of Classification Search

CPC ..... C11D 3/0073
USPC ..... 510/219
See application file for complete search history.

(56) References Cited

U.S. PATENT DOCUMENTS

| | | | | |
|---|---|---|---|---|
| 3,301,783 | A | 1/1967 | Dickson et al. | |
| 4,597,898 | A | 7/1986 | Meer | |
| 5,540,866 | A * | 7/1996 | Aszman | C11D 3/10 510/220 |
| 6,083,898 | A | 7/2000 | Meixner et al. | |
| 6,827,795 | B1 * | 12/2004 | Kasturi | A61K 8/44 134/39 |
| 8,535,450 | B2 | 9/2013 | Hueffer et al. | |
| 8,574,374 | B2 | 11/2013 | Hueffer et al. | |
| 8,709,990 | B2 | 4/2014 | Hueffer et al. | |
| 8,987,518 | B2 | 3/2015 | Altenhoff et al. | |
| 2003/0162684 | A1 * | 8/2003 | Huyhn | A47L 13/17 510/438 |
| 2003/0211965 | A1 | 11/2003 | Andrews et al. | |
| 2008/0153983 | A1 | 6/2008 | Boeckh et al. | |
| 2009/0215662 | A1 * | 8/2009 | Boeckh | C11D 3/3723 510/221 |
| 2011/0152157 | A1 * | 6/2011 | Woo | A61L 9/01 510/236 |
| 2011/0183883 | A1 * | 7/2011 | Hahn | C11D 3/0073 510/514 |
| 2012/0108487 | A1 * | 5/2012 | Graham | C11D 17/042 510/221 |
| 2014/0053877 | A1 * | 2/2014 | Letzelter | C11D 3/065 134/25.2 |
| 2014/0251385 | A1 * | 9/2014 | Kelly-Murray | A47L 15/0007 134/25.2 |

FOREIGN PATENT DOCUMENTS

| | | | | |
|---|---|---|---|---|
| DE | 198 19 187 | A1 | 11/1999 | |
| EP | 0 112 593 | | 7/1984 | |
| EP | 0 206 513 | | 12/1986 | |
| EP | 0 851 023 | A2 | 7/1998 | |
| WO | WO 97/23546 | A1 | 7/1997 | |
| WO | WO 01/96516 | A1 | 12/2001 | |
| WO | WO 2006/108857 | A1 | 10/2006 | |
| WO | WO 2009/060059 | A2 | 5/2009 | |
| WO | WO 2009/060060 | A1 | 5/2009 | |
| WO | WO 2009/060409 | A1 | 5/2009 | |
| WO | WO 2009/061980 | A1 | 5/2009 | |
| WO | WO 2009/061990 | A1 | 5/2009 | |
| WO | WO 2009/092699 | A1 | 7/2009 | |
| WO | WO 2009092699 | A1 * | 7/2009 | C11D 3/33 |
| WO | WO 2010/020765 | A1 | 2/2010 | |
| WO | WO 2012/153143 | | 11/2012 | |
| WO | WO 2014/131584 | A2 | 9/2014 | |
| WO | WO 2014/131710 | A1 | 9/2014 | |

OTHER PUBLICATIONS

U.S. Appl. No. 14/766,901, filed Aug. 10, 2015, Ebert, et al.
U.S. Appl. No. 14/763,203, filed Jul. 24, 2015, Ebert, et al.
International Search Report dated May 28, 2014 in PCT/EP2014/052174 (with English language translation).
Submission in opposition proceedings in European Application No. 14702846.8 dated Mar. 15, 2019.
Lulgavan P Data Sheet Form 2005.
Trilon Publication, published in 1998.

* cited by examiner

*Primary Examiner* — Nicole M. Buie-Hatcher
*Assistant Examiner* — M. Reza Asdjodi
(74) *Attorney, Agent, or Firm* — Oblon, McClelland, Maier & Neustadt, L.L.P.

(57) ABSTRACT

Formulation comprising
(A) at least one aminocarboxylate selected from methylglycin diacetate (MGDA), iminodisuccinic acid (IDA) and glutamic acid diacetate (GLDA), and salts thereof,
(B) at least one polypropyleneimine which may be alkoxylated.

15 Claims, No Drawings

FORMULATIONS, THEIR USE AS OR FOR PRODUCING DISHWASHING DETERGENTS AND THEIR PRODUCTION

The present invention relates to formulations comprising (A) at least one aminocarboxylate selected from methylglycine diacetate (MGDA), iminodisuccinic acid (IDA) and glutamic acid diacetate (GLDA), and salts thereof, and (B) at least one polypropyleneimine which may be alkoxylated.

Furthermore, the present invention relates to a process for producing formulations according to the invention and to their use as or for producing dishwashing detergents, in particular dishwashing detergents for machine dishwashing.

Dishwashing detergents have to meet many different requirements. For example, they have to clean the dishes thoroughly, they should have no harmful or potentially harmful substances in the wastewater, they should permit the running-off and drying of the water from the dishes, and they should not lead to problems during the operation of the dishwasher. Finally, they should not lead to aesthetically undesirable results on the item to be cleaned. In this connection, glass corrosion is to be mentioned in particular.

Glass corrosion arises not only as a result of mechanical effects, for example as a result of glasses rubbing together or mechanical contact between the glasses and parts of the dishwasher, but is primarily promoted by chemical influences. For example, certain ions can be dissolved out of the glass as a result of repeated machine cleaning, which adversely alters the optical and thus aesthetic properties.

Several effects are observed with glass corrosion. Firstly, the formation of microscopically fine cracks can be observed which become noticeable in the form of lines. Secondly, in many cases, general hazing can be observed, for example a roughening which makes the glass in question appear unattractive. Effects of this type are overall also subdivided into iridescent discoloration, scoring, as well as patchy and circular clouding.

WO 2006/108857 discloses alkoxylated polyethyleneimines as additives to detergents. By way of example, detergents are disclosed which comprise zeolites or polyaminocarboxylates such as EDTA or triethylenediamine pentaacetate as complexing agents.

WO 01/96516 proposes formulations which comprise alkoxylated polyethyleneimine for cleaning hard surfaces. Purified water is used for rinsing.

WO 2010/020765 discloses dishwashing detergents which comprise polyethyleneimine. Dishwashing detergents of this type can comprise phosphate or be phosphate-free. They are attributed good inhibition of glass corrosion. Zinc-containing and bismuth-containing dishwashing detergents are discouraged. Glass corrosion, in particular line corrosion and clouding, however, is in many cases still not adequately delayed or prevented.

It was therefore the object to provide formulations which are suitable as or for producing dishwashing detergents and which avoid the disadvantages known from the prior art and which inhibit glass corrosion or at least reduce it particularly well. It was also the object to provide a process for producing formulations which are suitable as or for producing dishwashing detergents and which avoid the disadvantages known from the prior art. It was also the object to provide uses of formulations.

Accordingly, the formulations defined at the outset have been found, also called for short formulations according to the invention.

Formulations according to the invention comprise (A) at least one aminocarboxylate selected from methylglycine diacetate (MGDA), iminodisuccinic acid (IDA) and glutamic acid diacetate (GLDA), and salts thereof, within the context of the present invention also referred to for short as aminocarboxylate (A) or else compound (A), and preferably salts thereof.

Preferably, compound (A) is selected as free acid, particularly preferably in partially or completely neutralized form, i.e. as salt. Suitable counterions are for example inorganic cations, for example ammonium, alkali metal or alkaline earth metal, preferably $Mg^{2+}$, $Ca^{2+}$, $Na^{+}$, $K^{+}$, or organic cations, preferably ammonium substituted with one or more organic radicals, in particular triethanolammonium, N,N-diethanolammonium, N-mono-$C_1$-$C_4$-alkyldiethanolammonium, for example N-methyldiethanolammonium or N-n-butyldiethanolammonium, and N,N-di-C1-$C_4$-alkylethanolammonium.

Very particularly preferred compounds (A) are the alkali metal salts, in particular the sodium salts of methylglycine diacetate (MGDA), iminodisuccinic acid (IDA) and glutamic acid diacetate (GLDA).

Methylglycine diacetate (MGDA), iminodisuccinic acid (IDA) or glutamic acid diacetate (GLDA) is very particularly preferably completely neutralized.

Formulations according to the invention furthermore comprise (B) at least one polypropyleneimine which may be alkoxylated.

Within the context of the present invention, alkoxylated polypropyleneimines are also called for short "modified polypropyleneimine (B)" or "alkoxylated polypropyleneimine (B)". Within the context of the present invention, nonalkoxylated polypropyleneimine is also referred to for short as "polypropyleneimine (B)".

In one embodiment of the present invention, polypropyleneimine (B) has a molecular weight $M_n$ in the range from 300 to 4000 g/mol, preferably 400 to 2000 g/mol.

In one embodiment of the present invention, modified polypropyleneimine (B) has an average molecular weight $M_w$ in the range from 800 to 25 000 g/mol.

Within the context of the present invention the expression polypropyleneimine refers not only to homopolymers of propylenediamine, but also to those polyalkyleneimines which, besides NH—$CH_2$—$CH_2$—$CH_2$—NH units and/or NH—$CH_2$—$CH(CH_3)$—NH units, have other alkylenediamine units, for example NH—$CH_2$—$CH_2$—NH units, NH—$(CH_2)_4$—NH units, NH—$(CH_2)_6$—NH units or NH—$(CH_2)_5$—NH units, but where NH—$CH_2$—$CH_2$—$CH_2$—NH units and/or NH—$CH_2$—$CH(CH_3)$—NH units are in the majority in molar terms. Preferred polypropyleneimines have for example at least 60 mol % propyleneimine units per molecule, particularly preferably at least 70 mol %.

In a particularly preferred embodiment, the expression polypropyleneimine refers to those polyalkyleneimines which have only one or even no structural element which is different from NH—$CH_2$—$CH_2$—$CH_2$—NH.

Polypropyleneimine can be linear, predominantly linear or branched, predominantly linear is preferred and linear is particularly preferred. The structure of polypropyleneimine can be controlled by the type of synthesis. Within the context of the present invention, polypropyleneimine can also be referred to as polypropylene polyamines.

Within the context of the present invention, polypropyleneimines have at least 6 N atoms per molecule, for example as $NH_2$ groups, as secondary amino groups or as tertiary amino groups.

Branches of polypropyleneimines may be for example $CH_2$—$CH_2$—$NH_2$ groups or $(CH_2)_3$—$NH_2$ units. Larger branches may be for example —$(CH_2)_3$—N $(CH_2CH_2CH_2NH_2)_2$ units. Highly branched polypropyleneimines can be for example polypropylene dendrimers or related molecules, for example with a degree of branching (DB) in the range from 0.25 to 0.95, preferably from 0.3 to 0.80 and particularly preferably of at least 0.5. The degree of branching of polypropyleneimines can likewise be determined by $^{13}C$ NMR or $^{15}N$-NMR spectroscopy, preferably in $D_2O$, and is defined as follows:

$$DB=D+T/D+T+L$$

with D (dendritic) corresponding to the fraction of tertiary amino groups, L (linear) corresponding to the fraction of secondary amino groups and T (terminal) corresponding to fraction of primary amino groups.

Within the context of the present invention, methyl groups are not classed as branches.

However, preference is given to polypropyleneimines with few or no branches, i.e. predominantly linear and in particular linear polypropyleneimines.

In some embodiments of the present invention, polypropyleneimine can be prepared by catalytic polycondensation of propanolamine and optionally at least one further amino alcohol or by catalytic poly-co-condensation of propanediol with propanediamine and optionally at least one further diol and/or at least one further diamine. Preferably, polypropyleneimine is prepared by catalytic polycondensation of propanediamine with optionally at least one further diamine. The latter type of polycondensation is also referred to as transamination. Further amino alcohols, diols and diamines are selected from aliphatic amino alcohols, aliphatic diols and aliphatic diamines.

Examples of aminopropanols are 3-amino-1-propanol, 1-amino-2-propanol and 2-amino-1-propanol and mixtures of the aforementioned aminopropanols, with 3-amino-1-propanol being preferred. Optionally, during the preparation of polypropyleneimines obtainable by polycondensation of amino alcohols up to 40 mol % of aminopropanol, preferably up to 30 mol % of aminopropanol, can be replaced by one or more amino alcohols which carry one hydroxy group and one primary or secondary amino group per mole.

Examples of further amino alcohols are linear or branched amino alcohols, for example monoethanolamine, diethanolamine, aminobutanol, for example 4-aminobutan-1-ol, 2-aminobutan-1-ol or 3-aminobutan-1-ol, aminopentanol, for example 5-aminopentan-1-ol or 1-aminopentan-2-ol, am inodimethylpentanol, for example 5-amino-2,2-dimethylpentanol, aminohexanol, for example 2-aminohexan-1-ol or 6-aminohexan-1-ol, aminoheptanol, for example 2-aminoheptan-1-ol or 7-aminoheptan-1-ol, aminooctanol, for example 2-aminooctan-1-ol or 8-aminooctan-1-ol, aminononanol, for example 2-aminononan-1-ol or 9-aminononan-1-ol, aminodecanol, for example 2-aminodecan-1-ol or 10-aminodecan-1-ol, aminoundecanol, for example 2-aminoundecan-1-ol or 11-aminoundecan-1-ol, aminododecanol, for example 2-aminododecan-1-ol or 12-aminododecan-1-ol, aminotridecanol, for example 2-aminotridecan-1-ol, where the ω-amino-α-alcohols in question are preferred in each case over their 1,2-isomers, 2-(2-aminoethoxy)ethanol, alkylalkanolamine, for example N-n-butylethanolamine, N-n-propylethanolamine, N-ethylethanolamine and N-methylethanolamine. Preference is given to monoethanolamine.

In one embodiment of the present invention, polypropyleneimine is obtained by catalytic polycondensation of 3-aminopropan-1-ol, without adding amino alcohol which is different from 3-aminopropan-1-ol.

Examples of propanediamines and propanediols which can be processed by poly-co-condensation to give polypropyleneimine are described below. Here, within the context of the present invention, the terms "propylenediamine" and "propanediamine" are used synonymously. Examples of propanediamines are propane-1,2-diamine and propane-1,3-diamine and mixtures of those specified above, with preference being given to propane-1,3-diamine. Examples of the corresponding propanediols are propane-1,3-diol and propane-1,2-diol and mixtures of those mentioned above, with propane-1,3-diol being preferred. In the case of the poly-co-condensation, the poly-co-condensation of propane-1,3-diol with propane-1,3-diamine is preferred.

Optionally, up to 40 mol % of the sum of propanediamine and propanediol can be replaced by one or more aliphatic diols or aliphatic diamines which are different in each case from propanediol or propanediamine, in particular up to 30 mol %.

Examples of further aliphatic diols are linear or branched diols. Specific examples are ethylene glycol, 2-methyl-1,3-propanediol, butanediols, for example 1,4-butylene glycol or butane-2,3-diol or 1,2-butylene glycol, pentanediols, for example neopentyl glycol or 1,5-pentanediol or 1,2-pentanediol, hexanediols, for example 1,6-hexanediol or 1,2-hexanediol, heptanediols, for example 1,7-heptanediol or 1,2-heptanediol, octanediols, for example 1,8-octanediol or 1,2-octanediol, nonanediols, for example 1,9-nonanediol or 1,2-nonanediol, decanediols, for example 1,10-decanediol or 1,2-decanediol, undecanediols, for example 1,11-undecanediol or 1,2-undecanediol, dodecanediols, for example 1,12-dodecanediol or 1,2-dodecanediol, tridecanediols, for example 1,13-tridecanediol or 1,2-tridecanediol, tetradecanediols, for example 1,14-tetradecanediol or 1,2-tetradecanediol, pentadecanediols, for example 1,15-pentadecanediol or 1,2-pentadecanediol, hexadecanediols, for example 1,16-hexadecanediol or 1,2-hexadecanediol, heptadecanediols, for example 1,17-heptadecanediol or 1,2-heptadecanediol, octadecanediols, for example 1,18-octadecanediol or 1,2-octadecanediol, with the respective α,ω-diols being preferred over their 1,2-isomers, 3,4-dimethyl-2,5-hexanediol, N,N-diethanolamines, for example N-n-butyldiethanolamine or N-methyldiethanolamine, and other dialcoholamines. Preference is given to ethylene glycol.

Examples of further aliphatic diamines are linear or branched diamines. Specific examples are ethylenediamine, butylenediamines, for example 1,4-butylenediamine or 1,2-butylenediamine, diaminopentanes, for example 1,5-diaminopentane or 1,2-diaminopentane, diaminohexane, for example 1,6-diaminohexane, 1,5-diamino-2-methylpentane or 1,2-diaminohexane, diaminoheptane, for example 1,7-diaminoheptane or 1,2-diaminoheptane, diaminooctane, for example 1,8-diaminooctane or 1,2-diaminooctane, diaminononane, for example 1,9-diaminononane or 1,2-diaminononane, diaminodecane, for example 1,10-diaminodecane or 1,2-diaminodecane, diaminoundecane, for example 1,11-diaminoundecane or 1,2-diaminoundecane, diaminododecane, for example 1,12-diaminododecane or 1,2-diaminododecane, with the respective α,ω-diamines being preferred over their 1,2-isomers, 2,2-dimethylpropane-1,3-diamines, 4,7,10-trioxatridecane-1,13-diamines, 4,9-dioxadodecane-1,12-diamines, and 3-(methylamino)propylamines. Preference is given to 1,2-ethylenediamine and 1,4-butanediamine.

Within the context of the present invention, compounds with two $NH_2$ groups and a tertiary amino group, for example N,N-bis(3-aminopropyl)methylamines, should also be classed as diamine.

In a preferred embodiment of the present invention, polypropyleneimine is prepared by catalytic poly-co-condensation of 1,3-propylene glycol with 1,3-propanediamine, and specifically without using diols and diamines which are different from 1,3-propylene glycol or 1,3-propanediamine.

The polycondensations or poly-co-condensations described above can be carried out in the absence or presence of hydrogen, for example under a hydrogen pressure in the range from 1 to 10 MPa.

The polycondensations or poly-co-condensations described above can be carried out at a temperature in the range from 20 to 250° C., preferably at least 100 and at most 200° C.

During the polycondensations or poly-co-condensations described above, the water formed during the reaction can be removed, for example by distillation.

Suitable catalysts for the polycondensations or poly-co-condensations described above can preferably be selected from homogenous catalysts.

Suitable homogeneous catalysts can be used in activated form or can be activated in situ during the polycondensation or poly-co-condensation.

Examples of catalysts for the homogenous catalysis are $Ru(p\text{-cumene})Cl_2]_2$, $[Ru(benzene)Cl_2]_y$, $[Ru(CO)_2Cl_2]_y$, where y is in each case in the range from 1 to 1000, $[Ru(CO)_3Cl_2]_2$, [Ru(COD)(allyl)], $RuCl_3.H_2O$, [Ru(acetylacetonate)$_3$], $[Ru(DMSO)_4Cl_2]$, $[Ru(Cp)(CO)_2Cl]$, $[Ru(Cp)(CO)_2H]$, $[Ru(Cp)(CO)_2]_2$, $[Ru(Cp)(CO)_2Cl]$, $[Ru(Cp^*)(CO)_2H]$, $[Ru(Cp^*)(CO)_2]_2$, $[Ru(indenyl)(CO)_2Cl]$, $[Ru(indenyl)(CO)_2H]$, $[Ru(indenyl)(CO)_2]_2$, ruthenocene, $[Ru(COD)Cl_2]_2$, $[Ru(Cp^*)(COD)Cl]$, $[Ru_3(CO)_{12}]$, $[Ru(PPh_3)_4(H)_2]$, $[Ru(PPh_3)_3(Cl)_2]$, $[Ru(PPh_3)_3(CO)(Cl)_2]$, $[Ru(PPh_3)_3(CO)(Cl)(H)]$, $[Ru(PPh_3)_3(CO)(H)_2]$ and $[Ru(Cp)(methylallyl)_2]$, $[Ru(bipy)_2Cl_2.2H2O]$, $[Ru(COD)Cl_2]_2$, $[Ru(Cp^*)(COD)Cl]$, $[Ru_3(CO)_{12}]$, [Ru(tetraphenylhydroxycyclopentadienyl)$(CO)_2H$], $[Ru(PMe_3)_4(H)_2]$, $[Ru(PEt_3)_4(H)_2]$, $[Ru(P(n\text{-}Pr)_3)_4(H)_2]$, $[Ru(P(n\text{-}Bu)_3)_4(H)_2]$, $[Ru(Pn\text{-}Octyl_3)_4(H)_2]$, $[IrCl_3.H2O]$, $KIrCl_4$, $K_3IrCl_6$, $[Ir(COD)Cl]_2$, $[Ir(cyclooctene)_2Cl]_2$, $[Ir(ethene)_2Cl]_2$, $[Ir(Cp)Cl_2]_2$, $[Ir(Cp^*)Cl_2]_2$, $[Ir(Cp)(CO)_2]$, $[Ir(Cp^*)(CO)_2]$, $[Ir(PPh_3)_2(CO)(H)]$, $[Ir(PPh_3)_2(CO)(Cl)]$, $[Ir(PPh_3)_3(Cl)]$ where the synthesis of the catalysts can take place by reacting commercially available compounds and the corresponding ligands.

Within the context of the present invention, the variables have the following meaning here, Cp means cyclopentadienyl and Cp* means pentamethylcyclopentadienyl. COD means cycloocta-1,5-dienyl, Et: ethyl, Me: methyl, Ph: phenyl, n-Pr: n-propyl, n-Bu: n-butyl, bipy: 2,2'-bipyridyl.

In one embodiment of the present invention, polypropyleneimines which are prepared by the polycondensation or poly-co-condensation described above have an OH number in the range from 1 to 1000 mg KOH/g, preferably 2 to 500 mg KOH/g, particularly preferably from 10 to 300 mg KOH/g. The OH number can be determined in accordance with DIN 53240.

In one embodiment of the present invention, polypropyleneimines which are prepared by the above-described polycondensation or poly-co-condensation have a primary amine value in the range from 1 to 1000 mg KOH/g, preferably 10 to 500 mg KOH/g, particularly preferably 50 to 300 mg KOH/g. The primary amine value can be determined in accordance with ASTM D2074-07.

In one embodiment of the present invention, polypropyleneimines which are prepared by the above-described polycondensation or poly-co-condensation have a secondary amine value in the range from 1 to 1000 mg KOH/g, preferably 10 to 500 mg KOH/g, particularly preferably 50 to 300 mg KOH/g. The secondary amine value can be determined in accordance with ASTM D2074-07.

In one embodiment of the present invention, polypropyleneimines which are prepared by the above-described polycondensation or poly-co-condensation have a tertiary amine value in the range from 1 to 300 mg KOH/g, preferably 5 to 200 mg KOH/g, particularly preferably 10 to 100 mg KOH/g. The tertiary amine value can be determined in accordance with ASTM D2074-07.

In one embodiment of the present invention, the molar fraction of the tertiary amine nitrogen atoms is determined by $^{15}$N-NMR spectroscopy. In cases where the tertiary amine value and that by means of $^{15}$N-NMR spectroscopy should provide inconsistent values for the tertiary amine nitrogen atoms, the values ascertained with the help of $^{15}$N-NMR spectroscopy are valid.

In a preferred embodiment of the present invention, polypropyleneimines can be obtained by catalytic transamination of propanediamine and optionally at least one further diamine. Examples of propanediamines are 1,2-propanediamine and 1,3-propanediamine. Particular preference is given to transaminations of 1,3-propanediamine.

Optionally, up to 40 mol % of propanediamine can be replaced by one or more aliphatic diamines different from propanediamine, in particular up to 30 mol %.

Examples of further aliphatic diamines are linear or branched diamines. Specific examples are ethylenediamine, butylenediamines, for example 1,4-butylenediamine or 1,2-butylenediamine, diaminopentanes, for example 1,5-diaminopentane or 1,2-diaminopentane, diaminohexane, for example 1,6-diaminohexane, 1,5-diamino-2-methylpentane or 1,2-diaminohexane, diaminoheptane, for example 1,7-diaminoheptane or 1,2-diaminoheptane, diaminooctane, for example 1,8-diaminooctane or 1,2-diaminooctane, diaminononane, for example 1,9-diaminononane or 1,2-diaminononane, diaminodecane, for example 1,10-diaminodecane or 1,2-diaminodecane, diaminoundecane, for example 1,11-diaminoundecane or 1,2-diaminoundecane, diaminododecane, for example 1,12-diaminododecane or 1,2-diaminododecane, with the respective α,ω-diamines being preferred over their 1,2-isomers, 2,2-dimethylpropane-1,3-diamine, 4,7,10-trioxatridecane-1,13-diamine, 4,9-dioxadodecane-1,12-diamine and 3-(methylamino)propylamines. Preference is given to 1,2-ethylenediamine and 1,4-butanediamine.

Within the context of the present invention, compounds with two $NH_2$ groups and a tertiary amino group, for example N,N-bis(3-aminopropyl)methylamines, should also be classed as diamine.

In a particularly preferred embodiment of the present invention, polypropyleneimine is obtained by catalytic transamination of 1,3-propanediamine, without adding a diamine different from 1,3-propanediamine.

Catalysts which are suitable for the transamination of propanediamine and optionally at least one further diamine are preferably heterogeneous catalysts which comprise at least one transition metal which is selected from Fe, Co, Ni, Ru, Rh, Pd, Os, Ir and Pt, preferably from Co, Ni, Ru, Cu and Pd, and particularly preferably from Co, Ni and Cu. Within the context of the present invention, the aforementioned metals can also be referred as "catalytically active metals".

In one embodiment of the present invention, a catalytically active metal may be doped with one or more promoters which is different from the catalytically active metal, for example with Cr, Co, Mn, Mo, Ti, Sn, alkali metal, alkaline earth metal or phosphorus.

Preference is given to using a catalyst of the Raney type which can be obtained by activating an alloy of a catalytically active metal with another metal, preferably aluminum. Preference is given to Raney nickel and Raney cobalt.

In one embodiment of the present invention, it is possible to use a supported Pd catalyst or a supported Pt catalyst. Examples of suitable support materials are carbon, for example as activated carbon, also $Al_2O_3$, $TiO_2$, $ZrO_2$ and $SiO_2$.

Particular preference is given to catalysts which can be obtained by reducing a catalyst precursor.

Catalyst precursors comprise an active mass of precursors of one or more catalytically active components, optionally one or more promoters and optionally a support material.

The catalytically active components are oxygen-containing compounds of the aforementioned catalytically active metals, for example their metal oxides and hydroxides, such as CoO, NiO, CuO and/or mixed oxides thereof.

The transamination of propanediamine and optionally further diamine can be carried out in the absence or presence of hydrogen, for example under a hydrogen pressure in the range from 1 to 400 bar, preferably up to 200 bar and particularly preferably up to 100 bar.

The transamination of propanediamine and optionally further diamine can be carried out at a temperature in the range from 50 to 200° C., preferably 90 to 180° C. and particularly preferably 120 to 160° C.

The transamination of propanediamine and optionally further diamine can be carried out at a pressure in the range from 1 to 400 bar, preferably up to 200 bar and particularly preferably up to 100 bar.

The above-described transaminations of propanediamine give linear polypropyleneimine.

A polypropyleneimine is obtained which has no hydroxyl groups. The OH number in accordance with DIN 53240 is accordingly zero. This statement naturally refers to the polypropyleneimine prior to the alkoxylation.

In one embodiment of the present invention, polypropyleneimines which are prepared by the above-described transamination have a primary amine value in the range from 10 to 1000 mg KOH/g, preferably 80 to 800 mg KOH/g, particularly preferably 100 to 500 mg KOH/g. The primary amine value can be determined in accordance with ASTM D2074-07.

In one embodiment of the present invention, polypropyleneimines which are prepared by the above-described transamination have a secondary amine value in the range from 100 to 2000 mg KOH/g, preferably 200 to 1500 mg KOH/g, particularly preferably 300 to 1000 mg KOH/g. The secondary amine value can be determined in accordance with ASTM D2074-07.

In one embodiment of the present invention, polypropyleneimines which are prepared by the above-described transamination have zero to 2 mol % of tertiary amine nitrogen atoms, based on all of the N atoms in the molecule in question. The molar fraction of the tertiary amine nitrogen atoms is preferably determined by $^{15}$N-NMR spectroscopy.

In one preferred embodiment of the present invention, the average molecular weight $M_n$ of polypropyleneimine (B) is in the range from 300 to 4000 g/mol, particularly preferably in the range from 400 to 2000 g/mol. The average molecular weight $M_n$ can be obtained for example by gel permeation chromatography (GPC) or by end group analysis, for example by NMR spectroscopy.

In one preferred embodiment of the present invention, the breadth of the molecular weight distribution $M_w/M_n$ of polypropyleneimine (B) is in the range from 1.2 to 20, preferably in the range from 1.5 to 7.5.

In one embodiment of the present invention, the cationic charge density of alkoxylated polypropyleneimine is in the range from 4 to 22 meq/g dry mass, preferably in the range from 6 to 18 meq/g dry mass, determined at a pH in the range from 3 to 4 by titration.

In one embodiment of the present invention, polypropyleneimine (B) is used in covalently modified form, specifically such that preferably 90 to 100 mol % of the nitrogen atoms of the primary and secondary amino groups of the polypropyleneimine (B) have been alkoxylated. For the alkoxylation, epoxides can be used, for example ethylene oxide, propylene oxide, 1,2-butylene oxide, 2,3-butylene oxide, styrene oxide or epichlorohydrin. Preferred alkoxylation reagents are butylene oxide, ethylene oxide and propylene oxide, and also combinations of ethylene oxide and of propylene oxide. If combinations of ethylene oxide and propylene oxide are used, then the different alkylene oxides can be incorporated blockwise or randomly.

In one embodiment of the present invention, modified polypropyleneimine (B) is selected from polypropyleneimines alkoxylated with ethylene oxide or propylene oxide. Very particular preference is given to using modified polypropyleneimine (B) alkoxylated with ethylene oxide as the sole alkylene oxide.

In one embodiment of the present invention, the molar ratio of nitrogen atoms to alkylene oxide groups in modified polypropyleneimine (B) is in the range from 1:1 to 1:00, preferably in the range from 1:2 to 1:15.

The alkoxylation of polypropyleneimine (B) can for example be carried out as follows. Preferably, the alkoxylation is carried out as a catalytic alkoxylation. Suitable catalysts are for example Lewis acids, for example $AlCl_3$ or $BF_3$ etherate, $BF_3$, $BF_3.H_3PO_4$, $SbCl_5.2H_2O$ and hydrotalcite. Preferred catalysts are strong bases, for example potassium hydroxide, sodium hydroxide, potassium or sodium alcoholates such as for example potassium methylate ($KOCH_3$), sodium methylate ($NaOCH_3$), potassium ethanolate, sodium ethanolate and potassium tert-butanolate. Further suitable strong bases are sodium hydride, calcium hydride and alkali metal carbonates such as for example sodium carbonate and potassium carbonate. Particularly preferred catalysts are alkali metal hydroxides and alkali metal alcoholates, very particularly preferably sodium hydroxide and potassium hydroxide. As a rule, 0.05 to 10% by weight of catalyst can be used, preferably 0.5 to 2% by weight, based on the sum of polypropyleneimine and alkylene oxide.

In one embodiment of the present invention, the alkoxylation is carried out a temperature in the range from 90 to 240° C., preferably in the range from 120 to 180° C., and specifically in a closed vessel, for example in an autoclave.

In one embodiment of the present invention, the alkoxylation is carried out at a pressure in the range from 1 to 10 bar, preferably up to 8 bar.

In one embodiment of the present invention, alkylene oxide(s) and polypropyleneimine and optionally catalyst are reacted with one another under the vapor pressure of the alkylene oxide in question or the mixture of the alkylene oxides in question at the selected temperature.

Alkylene oxide(s) can be introduced in pure form or—as alternative—in a form diluted with inert gas, for example in 30 to 60 volume% mixture. Examples of suitable inert gases are noble gases and in particular nitrogen. A dilution can be chosen for example as a safety measure against an explosion-like polyaddition of alkylene oxides.

In embodiments where it is desired to introduce more than just one alkylene oxide into the polyether side chains of modified polypropyleneimine (B), the different alkylene oxide units can be distributed randomly or blockwise. If a plurality of alkylene oxides is introduced simultaneously into the reaction, then deviations from the strict principle of chance during the incorporation of the alkylene oxide units can result therefrom such that different alkylene oxides have a different reactivity. By means of a programmed feeding of the alkylene oxides it is possible to achieve a predetermined incorporation of the alkylene oxide units. If the alkylene oxides are fed in one after the other, then a blockwise distribution of the alkylene oxide units is generally obtained.

The alkoxylation can preferably be carried out in two or more part steps, the first step consisting in firstly partly alkoxylating polypropyleneimine. This should be understood as meaning that polypropyleneimine is reacted with a number of moles of alkylene oxide which corresponds to the number of primary and secondary amino groups in the polypropyleneimine in question. The partial alkoxylation is preferably carried out in aqueous solution and without catalyst.

In one embodiment of the present invention, the partial alkoxylation can be carried out at a reaction temperature in the range from 70 to 200° C., preferably in the range from 80 to 160° C.

In one embodiment of the present invention, the partial alkoxylation can be carried out at a pressure of up to 10 bar, preferably up to 8 bar. A lower limit which may be mentioned is atmospheric pressure.

In the second part step—and optionally in further part steps—alkoxylation is then carried out with further alkylene oxide. This further alkoxylation is carried out in the presence of catalyst. Suitable catalysts are those specified above.

The second part step—and optionally the further part steps—can be carried out in each case without dilution, variant (i), or in an organic solvent, variant (ii). To carry out variant (i), the water can be removed from part step, preferably prior to adding a water-sensitive catalyst. The water can for example be distilled off by heating to a temperature in the range from 80 to 150° C. at reduced pressure in the range from 0.01 to 0.5 bar. If the catalyst is water-insensitive, for example alkali metal hydroxide, then it is possible to firstly add the catalyst and then to remove the water.

In one embodiment of the present invention, the further alkoxylation can be carried out at a reaction temperature in the range from 70 to 200° C., preferably in the range from 100 to 180° C.

In one embodiment of the present invention, further alkoxylation can be carried out at a pressure of up to 10 bar, preferably up to 8 bar. A lower limit which may be mentioned is atmospheric pressure.

In one embodiment of the present invention, the further alkoxylation is carried out over a period of from 30 minutes up to 12 hours.

Examples of suitable solvents for carrying out variant (ii) are nonpolar and polar aprotic organic solvents. Examples of particularly suitable nonpolar aprotic organic solvents are aliphatic and aromatic hydrocarbons such as for example n-hexane, n-heptane, cyclohexane, toluene and the various isomers of xylene. Examples of particularly suitable polar aprotic solvents are ethers, in particular cyclic ethers such as tetrahydrofuran and 1,4-dioxane, furthermore N,N-dialkylamides such as dimethylformamide and dimethylacetamide and N-alkyllactams such as N-methylpyrrolidone and N-ethylpyrrolidone. It is also possible to use mixtures of two or more of the aforementioned solvents. Particularly preferred solvents are xylene, in particular as isomer mixture, and toluene.

For variant (ii) as well it is advantageous to remove any water stemming from the part step of the partial alkoxylation, and specifically preferably also before the addition of catalyst, for example at a temperature in the range from 120 to 180° C. and at reduced pressure, for example 0.01 to 0.5 bar, or by stripping with nitrogen. After adding the solvent, the further alkoxylation then takes place as in the second and any further part steps of variant (ii). Prior to further processing, the organic solvent(s) is/are removed.

Polypropyleneimine (B), which may be alkoxylated, can have, as counterions, high molecular weight or low molecular weight anions, organic or preferably inorganic. Within the context of the present invention, high molecular weight anions have an average molecular weight of 200 g/mol or more, for example up to 2500 g/mol, low molecular weight anions have a molecular weight of less than 200 g/mol, for example of 17 to 150 g/mol. Examples of low molecular weight organic counterions are acetate, propionate and benzoate. Examples of low molecular weight inorganic counterions are sulfate, chloride, bromide, hydroxide, carbonate, methanesulfonate and hydrogencarbonate.

In one embodiment of the present invention, modified polypropyleneimine (B) has a cationic charge density of at least 5 meq/g up to preferably at most 25 meq/g (milliequivalents/g), preferably up to 22 meq/g, the data in g referring to modified polypropyleneimine (B) without taking into consideration the counterions. The cationic charge density can be ascertained for example by titration, for example with polyvinylsulfate solution.

In one embodiment of the present invention, modified polypropyleneimine (B) has a molecular weight distribution $M_w/M_n$ in the range from 1.1 to 10, preferably 1.5 to 5.

In one embodiment of the present invention, formulations according to the invention comprise in total in the range from 1 to 50% by weight aminocarboxylate (A), preferably 10 to 25% by weight, in total in the range from 0.001 to 5% by weight polypropyleneimine (B), which may be alkoxylated, preferably 0.02 to 0.5% by weight, based in each case on the solids content of the formulation in question.

In one variant of the present invention, formulation according to the invention comprises compound (A) and polypropyleneimine (B), which may be alkoxylated, in a weight ratio in the range from 1000:1 to 25:1.

In a preferred embodiment of the present invention, formulation according to the invention is free from phosphates and polyphosphates, where hydrogenphosphates are subsumed, for example free from trisodiumphosphate, pentasodiumtripolyphosphate and hexasodiummetaphosphate. In connection with phosphates and polyphosphates, within the context of the present invention, "free from" should be understood as meaning that the content of phosphate and polyphosphate is in sum in the range from 10 ppm to 0.2% by weight, determined by gravimetry.

In one embodiment of the present invention, formulations according to the invention comprise at least one zinc salt. Zinc salts can be selected from water-soluble and water-insoluble zinc salts. In this connection, within the context of the present invention, water-insoluble is used to refer to those zinc salts which, in distilled water at 25° C., have a solubility of 0.1 g/l or less. Zinc salts which have a higher solubility in water are accordingly referred to within the context of the present invention as water-soluble zinc salts.

In one embodiment of the present invention, zinc salt is selected from zinc benzoate, zinc gluconate, zinc lactate, zinc formate, $ZnCl_2$, $ZnSO_4$, zinc acetate, zinc citrate, $Zn(NO_3)_2$, $Zn(CH_3SO_3)_2$ and zinc gallate, preferably $ZnCl_2$, $ZnSO_4$, zinc acetate, zinc citrate, $Zn(NO_3)_2$, $Zn(CH_3SO_3)_2$ and zinc gallate.

In another embodiment of the present invention, zinc salt is selected from ZnO, ZnO.aq, $Zn(OH)_2$ and $ZnCO_3$. Preference is given to ZnO.aq.

In one embodiment of the present invention, zinc salt is selected from zinc oxides with an average particle diameter (weight-average) in the range from 10 nm to 100 μm.

The cation in zinc salt can be present in complexed form, for example complexed with ammonia ligands or water ligands, and in particular be present in hydrated form. To simplify the notation, within the context of the present invention, ligands are generally omitted if they are water ligands.

Depending on how the pH of mixture according to the invention is adjusted, zinc salt can change. Thus, it is for example possible to use zinc acetate or $ZnCl_2$ for preparing formulation according to the invention, but this converts at a pH of 8 or 9 in an aqueous environment to ZnO, $Zn(OH)_2$ or ZnO.aq, which can be present in non-complexed or in complexed form.

Zinc salt is present in those formulations according to the invention which are solid at room temperature are preferably present in the form of particles which have for example an average diameter (number-average) in the range from 10 nm to 100 μm, preferably 100 nm to 5 μm, determined for example by X-ray scattering.

Zinc salt is present in those formulations according to the invention which are liquid at room temperature in dissolved or in solid or in colloidal form.

In one embodiment of the present invention, formulations according to the invention comprise in total in the range from 0.05 to 0.4% by weight of zinc salt, based in each case on the solids content of the formulation in question.

Here, the fraction of zinc salt is given as zinc or zinc ions. From this, it is possible to calculate the counterion fraction.

In one embodiment of the present invention, formulations according to the invention are free from heavy metals apart from zinc compounds. Within the context of the present invention, this may be understood as meaning that formulations according to the invention are free from those heavy metal compounds which do not act as bleach catalysts, in particular of compounds of iron and of bismuth. Within the context of the present invention, "free from" in connection with heavy metal compounds is to be understood as meaning that the content of heavy metal compounds which do not act as bleach catalysts is in sum in the range from 0 to 100 ppm, determined by the leach method and based on the solids content. Preferably, formulation according to the invention has, apart from zinc, a heavy metal content below 0.05 ppm, based on the solids content of the formulation in question. The fraction of zinc is thus not included.

Within the context of the present invention, "heavy metals" are deemed to be all metals with a specific density of at least 6 g/cm$^3$ with the exception of zinc. In particular, the heavy metals are precious metals such as bismuth, iron, copper, lead, tin, nickel, cadmium and chromium.

Preferably, the formulation according to the invention comprises no measurable fractions of bismuth compounds, i.e. for example less than 1 ppm.

Formulations according to the invention can comprise further components which are advantageous for example for use when washing dishes and/or kitchen utensils.

In another embodiment of the present invention, formulations according to the invention comprise no further components which are advantageous for example for use when washing dishes and/or kitchen utensils, but can be readily formulated with further components and are therefore suitable as starting material.

In one embodiment of the present invention, formulations according to the invention comprise sodium citrate (C). In this connection, the term sodium citrate includes the monosodium salt and preferably the disodium salt. Sodium citrate can be used as anhydrous salt or as hydrate, for example as dihydrate.

In one embodiment of the present invention, formulations according to the invention comprise (D) at least one compound selected from alkali metal percarbonate, alkali metal perborate and alkalimetal persulfate, within the context of the present invention also called "bleach (D)".

Preferred bleaches (D) are selected from sodium perborate, anhydrous or, for example, as monohydrate or as tetrahydrate or so-called dihydrate, sodium percarbonate, anhydrous or, for example, as monohydrate, and sodium persulfate, the term "persulfate" in each case including the salt of the peracid $H_2SO_5$ and also the peroxodisulfate.

In this connection, the alkali metal salts can in each case also be alkali metal hydrogen-carbonate, alkali metal hydrogen perborate and alkali metal hydrogen persulfate. However, preference is given in each case to the dialkali metal salts.

In one embodiment of the present invention, formulation according to the invention comprises zero to 50% by weight of sodium citrate (C), preferably 1 to 30% by weight, particularly preferably at least 5% by weight of sodium citrate (C), determined as anhydrous sodium citrate, in total zero to 15% by weight of bleach (D), preferably at least 0.5% by weight of bleach (D), selected from alkali metal percarbonate, alkali metal perborate and alkali metal persulfate, based in each case on solids content of the formulation in question.

In one embodiment of the present invention, formulation according to the invention is solid at room temperature, for example a powder or a tablet. In another embodiment of the present invention, formulation according to the invention is liquid at room temperature. In one embodiment of the present invention, formulation according to the invention is granules, a liquid preparation or a gel.

In one embodiment of the present invention, formulation according to the invention comprises 0.1 to 10% by weight of water, based on the sum of all solids of the formulation in question.

In one embodiment of the present invention, formulation according to the invention can have further ingredients (E), for example one or more surfactants, one or more enzymes, one or more builders, in particular phosphorus-free builders, one or more cobuilders, one or more alkali carriers, one or more bleaches, one or more bleach catalysts, one or more bleach activators, one or more bleach stabilizers, one or more antifoams, one or more corrosion inhibitors, one or more builder substances, buffers, dyes, one or more fragrances, one or more organic solvents, one or more tableting auxiliaries, one or more disintegrants, one or more thickeners, or one or more solubility promoters.

Examples of surfactants are in particular nonionic surfactants and also mixtures of anionic or zwitterionic surfactants with nonionic surfactants. Preferred nonionic surfactants are alkoxylated alcohols and alkoxylated fatty alcohols, di- and multiblock copolymers of ethylene oxide and propylene oxide and reaction products of sorbitan with ethylene oxide or propylene oxide, alkyl glycosides and so-called amine oxides.

Preferred examples of alkoxylated alcohols and alkoxylated fatty alcohols are, for example, compounds of the general formula (I)

(I)

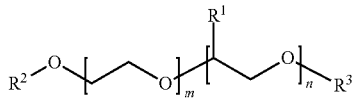

in which the variables are defined as follows:

$R^1$ is identical or different and selected from linear $C_1$-$C_{10}$-alkyl, preferably in each case identical and ethyl and particularly preferably methyl, $R^2$ is selected from $C_8$-$C_{22}$-alkyl, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^3$ is selected from $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, m and n are in the range from zero to 300, where the sum of n and m is at least one. Preferably, m is in the range from 1 to 100 and n is in the range from 0 to 30.

Here, compounds of the general formula (I) may be block copolymers or random copolymers, preference being given to block copolymers.

Other preferred examples of alkoxylated alcohols and alkoxylated fatty alcohols are, for example, compounds of the general formula (II)

(II)

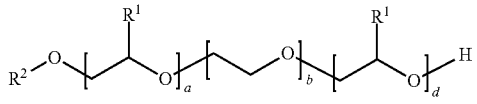

in which the variables are defined as follows:

$R^1$ is identical or different and selected from linear $C_1$-$C_0$-alkyl, preferably identical in each case and ethyl and particularly preferably methyl, $R^4$ is selected from $C_6$-$C_{20}$-alkyl, in particular n-$C_8H_{17}$, n-$C_{10}H_{21}$, n-$C_{12}H_{25}$, n-$C_{14}H_{29}$, n-$C_{16}H_{33}$, n-$C_{18}H_{37}$, a is a number in the range from 1 to 6, b is a number in the range from 4 to 20, d is a number in the range from 4 to 25.

Here, compounds of the general formula (II) may be block copolymers or random copolymers, preference being given to block copolymers.

Further suitable nonionic surfactants are selected from di- and multiblock copolymers, composed of ethylene oxide and propylene oxide. Further suitable nonionic surfactants are selected from ethoxylated or propoxylated sorbitan esters. Amine oxides or alkyl glycosides are likewise suitable. An overview of suitable further nonionic surfactants can be found in EP-A 0 851 023 and in DE-A 198 19 187.

Mixtures of two or more different nonionic surfactants may also be present.

Examples of anionic surfactants are $C_8$-$C_{20}$-alkyl sulfates, $C_8$-$C_{20}$-alkylsulfonates and $C_8$-$C_{20}$-alkyl ether sulfates with one to 6 ethylene oxide units per molecule.

In one embodiment of the present invention, the formulation according to the invention can comprise in the range from 3 to 20% by weight of surfactant.

Formulations according to the invention can comprise one or more enzymes. Examples of enzymes are lipases, hydrolases, amylases, proteases, cellulases, esterases, pectinases, lactases and peroxidases.

Formulations according to the invention can comprise, for example, up to 5% by weight of enzyme, preference being given to 0.1 to 3% by weight, in each case based on the total solids content of the formulation according to the invention.

Over and above sodium citrate (C), formulations according to the invention can comprise one or more builders, in particular phosphate-free builders. Examples of suitable builders are silicates, in particular sodium disilicate and sodium metasilicate, zeolites, sheet silicates, in particular those of the formula $\alpha$-$Na_2Si_2O_5$, $\beta$-$Na_2Si_2O_5$, and $\delta$-$Na_2Si_2O_5$, also fatty acid sulfonates, $\alpha$-hydroxypropionic acid, alkali metal malonates, fatty acid sulfonates, alkyl and alkenyl disuccinates, tartaric acid diacetate, tartaric acid monoacetate, oxidized starch, and polymeric builders, for example polycarboxylates and polyaspartic acid.

In one embodiment of the present invention, builders are selected from polycarboxylates, for example alkali metal salts of (meth)acrylic acid homopolymers or (meth)acrylic acid copolymers.

Suitable comonomers are monoethylenically unsaturated dicarboxylic acids such as maleic acid, fumaric acid, maleic anhydride, itaconic acid and citraconic acid. A suitable polymer is in particular polyacrylic acid, which preferably has an average molecular weight $M_w$ in the range from 2000 to 40 000 g/mol, preferably 2000 to 10 000 g/mol, in particular 3000 to 8000 g/mol. Also of suitability are copolymeric polycarboxylates, in particular those of acrylic acid with methacrylic acid and of acrylic acid or methacrylic acid with maleic acid and/or fumaric acid.

It is also possible to use copolymers of at least one monomer from the group consisting of monoethylenically unsaturated $C_3$-$C_{10}$-mono- or $C_4$-$C_{10}$-dicarboxylic acids or anhydrides thereof, such as maleic acid, maleic anhydride, acrylic acid, methacrylic acid, fumaric acid, itaconic acid and citraconic acid, with at least one hydrophilically or hydrophobically modified monomer as listed below.

Suitable hydrophobic monomers are, for example, isobutene, diisobutene, butene, pentene, hexene and styrene, olefins with 10 or more carbon atoms or mixtures thereof, such as, for example, 1-decene, 1-dodecene, 1-tetradecene, 1-hexadecene, 1-octadecene, 1-eicosene, 1-docosene, 1-tetracosene and 1-hexacosene, $C_{22}$-$\alpha$-olefin, a mixture of $C_{20}$-$C_{24}$-$\alpha$-olefins and polyisobutene having on average 12 to 100 carbon atoms per molecule.

Suitable hydrophilic monomers are monomers with sulfonate or phosphonate groups, and also nonionic monomers with hydroxyl function or alkylene oxide groups. By way of example, mention may be made of: allyl alcohol, isoprenol, methoxypolyethylene glycol(meth)acrylate, methoxypolypropylene glycol(meth)acrylate, methoxypolybutylene glycol(meth)acrylate, methoxypoly(propylene oxide-co-ethylene oxide)(meth)acrylate, ethoxypolyethylene glyco(meth)acrylate, ethoxypolypropylene glycol(meth)acrylate, ethoxypolybutylene glycol(meth)acrylate and ethoxypoly(propylene oxide-co-ethylene oxide)(meth)acrylate. Polyalkylene glycols here can comprise 3 to 50, in particular 5 to 40 and especially 10 to 30 alkylene oxide units per molecule.

Particularly preferred sulfonic-acid-group-containing monomers here are 1-acrylamido-1-propanesulfonic acid, 2-acrylamido-2-propanesulfonic acid, 2-acrylamido-2-methylpropanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide, and salts of said acids, such as sodium, potassium or ammonium salts thereof.

Particularly preferred phosphonate-group-containing monomers are vinylphosphonic acid and its salts.

Moreover, amphoteric polymers can also be used as builders.

Formulations according to the invention can comprise, for example, in the range from in total 10 to 50% by weight, preferably up to 20% by weight, of builders.

In one embodiment of the present invention, formulations according to the invention can comprise one or more cobuilders.

Examples of cobuilders are phosphonates, for example hydroxyalkanephosphonates and aminoalkanephosphonates. Among the hydroxyalkanephosphonates, 1-hydroxyethane-1,1-diphosphonate (HEDP) is of particular importance as a cobuilder. It is preferably used as the sodium salt, the disodium salt giving a neutral reaction and the tetrasodium salt an alkaline reaction (pH 9). Suitable aminoalkanephosphonates are preferably ethylenediaminetetramethylenephosphonate (EDTMP), diethylenetriaminepentamethylenephosphonate (DTPMP) and higher homologs thereof. They are preferably used in the form of the neutrally reacting sodium salts, e.g. as hexasodium salt of EDTMP or as hepta- and octasodium salt of DTPMP.

Formulations according to the invention can comprise one or more alkali carriers. Alkali carriers ensure, for example, a pH of at least 9 if an alkaline pH is desired. Of suitability are, for example, alkali metal carbonates, alkali metal hydrogen carbonates, alkali metal hydroxides and alkali metal metasilicates. A preferred alkali metal is in each case potassium, particular preference being given to sodium.

Besides bleach (D), formulations according to the invention can comprise one or more chlorine-containing bleaches.

Suitable chlorine-containing bleaches are, for example, 1,3-dichloro-5,5-dimethylhydantoin, N-chlorosulfamide, chloramine T, chloramine B, sodium hypochlorite, calcium hypochlorite, magnesium hypochlorite, potassium hypochlorite, potassium dichloroisocyanurate and sodium dichloroisocyanurate.

Formulations according to the invention can comprise, for example, in the range from 3 to 10% by weight of chlorine-containing bleach.

Formulations according to the invention can comprise one or more bleach catalysts. Bleach catalysts can be selected from bleach-boosting transition metal salts or transition metal complexes such as, for example, manganese-, iron-, cobalt-, ruthenium- or molybdenum-salen complexes or -carbonyl complexes. Manganese, iron, cobalt, ruthenium, molybdenum, titanium, vanadium and copper complexes with nitrogen-containing tripod ligands and also cobalt-, iron-, copper- and ruthenium-amine complexes can also be used as bleach catalysts.

Formulations according to the invention can comprise one or more bleach activators, for example N-methylmorpholinium-acetonitrile salts ("MMA salts"), trimethylammonium acetonitrile salts, N-acylimides such as, for example, N-nonanoylsuccinimide, 1,5-diacetyl-2,2-dioxohexahydro-1,3,5-triazine ("DADHT") or nitrile quats (trimethylammonium acetonitrile salts).

Further examples of suitable bleach activators are tetraacetylethylenediamine (TAED) and tetraacetylhexylenediamine.

Formulations according to the invention can comprise one or more corrosion inhibitors. In the present case, this is to be understood as including those compounds which inhibit the corrosion of metal. Examples of suitable corrosion inhibitors are triazoles, in particular benzotriazoles, bisbenzotriazoles, aminotriazoles, alkylaminotriazoles, also phenol derivatives such as, for example, hydroquinone, pyrocatechol, hydroxyhydroquinone, gallic acid, phloroglucinol or pyrogallol.

In one embodiment of the present invention, formulations according to the invention comprise in total in the range from 0.1 to 1.5% by weight of corrosion inhibitor.

Formulations according to the invention can comprise one or more builder substances, for example sodium sulfate.

Formulations according to the invention can comprise one or more antifoams, selected for example from silicone oils and paraffin oils.

In one embodiment of the present invention, formulations according to the invention comprise in total in the range from 0.05 to 0.5% by weight of antifoam.

Formulations according to the invention can comprise phosphonic acid or one or more phosphonic acid derivatives, for example hydroxyethane-1,1-diphosphonic acid.

The present invention further provides the use of formulations according to the invention for the machine cleaning of dishes and kitchen utensils. Within the scope of the present invention, kitchen utensils which may be mentioned are, for example, pots, pans, casseroles, also objects made of metal such as, for example, slotted spoons, fish slices and garlic presses.

Preference is given to the use of formulations according to the invention for the machine cleaning of objects which have at least one surface made of glass, which may be decorated or undecorated. In this connection, within the context of the present invention, a surface made of glass is to be understood as meaning that the object in question has at least one section made of glass which comes into contact with the ambient air and can become soiled upon use of the object. Thus, the objects in question may be those which, like drinking glasses or glass bowls, are essentially made of glass. However, they may, for example, also be lids which have individual components made of a different material, for example pot lids with rim and handle made of metal.

Surfaces made of glass can be decorated, for example colored or imprinted, or be undecorated.

The term "glass" includes any desired types of glass, for example lead glass and in particular soda-lime glass, crystal glass and borosilicate glasses.

Preferably, machine cleaning is washing with a dishwasher (automatic dishwashing).

In one embodiment of the present invention, at least one formulation according to the invention is used for the machine cleaning of drinking glasses, glass vases and glass vessels for cooking.

In one embodiment of the present invention, for the cleaning, water with a hardness in the range from 1 to 30° German hardness, preferably 2 to 25° German hardness is used, with German hardness being understood in particular as meaning the calcium hardness.

For the rinsing as well, it is also possible to use water with a hardness in the range from 1 to 30° German hardness, preferably 2 to 25° German hardness.

If formulations according to the invention are used for machine cleaning, then even in the case of repeated machine cleaning of objects which have at least one surface made of glass, only a very slight tendency towards glass corrosion is observed, and only then if objects which have at least one surface made of glass are cleaned together with heavily soiled cutlery or dishes. Furthermore, it is significantly less harmful to use the formulation according to the invention to clean glass together with objects made of metal, for example together with pots, pans or garlic presses.

Furthermore, it can be observed that formulations according to the invention have a very good bleaching effect when used for washing dishes and kitchen utensils and glass surfaces.

The present invention further provides a process for producing formulations according to the invention, for short also called production process according to the invention. To carry out the production process according to the invention, the procedure may, for example, be such that (A) aminocarboxylate selected from methylglycinee diacetate (MGDA), iminodisuccinic acid (IDA) and glutamic acid diacetate (GLDA) and salts thereof, and (B) at least one polypropyleneimine, which may be alkoxylated, and optionally (C) sodium citrate or (D) at least one compound selected from alkali metal percarbonate, alkali metal perborate and alkali metal persulfate, and optionally further components (E) are mixed together in one or more steps in the presence of water and then the water is completely or partially removed.

Compound (A), modified polypropyleneimine (B) and bleach (D) are defined above.

In one embodiment of the present invention, before the water is at least partially removed, mixing with one or more further ingredients (E) for the formulation according to the invention is possible, for example with one or more surfactants, one or more enzymes, one or more builders, one or more cobuilders, in particular phosphorus-free builders, one or more alkali carriers, one or more bleaches, one or more bleach catalysts, one or more bleach activators, one or more bleach stabilizers, one or more antifoams, one or more corrosion inhibitors, one or more builder substances, with buffer or dye.

In one embodiment, the procedure involves removing the water from the formulation according to the invention entirely or partially, for example to a residual moisture in the range from 0.1 to 10% by weight, by evaporating it, in particular by means of spray-drying, spray granulation or compaction.

In one embodiment of the present invention, the water is removed, completely or partially, at a pressure in the range from 0.3 to 2 bar.

In one embodiment of the present invention, the water is removed, completely or partially, at temperatures in the range from 60 to 220° C.

By means of the production process according to the invention, formulations according to the invention can be obtained easily.

The cleaning formulations according to the invention can be provided in liquid or solid form, in a single-phase or multiphase, as tablets or in the form of other dosage units, in packaged or unpackaged form. The water content of liquid formulations can vary from 35 to 90% water.

A further subject matter of the present invention is modified polypropyleneimines (B) prepared by alkoxylation of polypropyleneimine which is prepared by transamination of propanediamine and optionally up to 40 mol % of at least one further aliphatic diamine. Preparation and the properties of modified polypropyleneimines (B) according to the invention are described above.

The invention is illustrated by working examples.

General: It was ensured that after the first cleaning of the test bodies in the domestic dishwasher until after the weighing and visual inspection of the glasses, the test bodies were handled only with clean cotton gloves so that the weight and/or the visual impression of the test bodies was not falsified.

Data in % are % by weight, unless expressly stated otherwise. Data in ° German hardness always relate to the permanent hardness.

I. Preparation of Alkoxylated Polypropyleneimines

I.1 Preparation of Polypropyleneimines

I.1.1 Preparation of Linear Polypropyleneimine L-PPI.1

200 ml of 1,3-propanediamine ("1,3-PDA") was poured into a 300 ml steel vessel which was connected to a tubular reactor with an internal diameter of 27 mm. The 1,3-PDA was pumped out of the steel vessel together with 50 l (stp) of hydrogen over a fixed-bed catalyst made of Ni/Co which was supported on $ZrO_2$ and which was located in the tubular reactor. The reaction temperature was 160° C. At the top of the tubular reactor, gas and liquid phase were separated and the liquid fraction was returned to the steel vessel. From there, it was pumped again over the catalyst. The reaction was carried out for 2 hours. This gave L-PPI.1, the properties of which are listed in table 1.

I.1.2 Preparation of Linear Polypropyleneimine L-PPI.2

200 ml of 1,3-propanediamine ("1,3-PDA") was poured into a 300 ml steel vessel which was connected to a tubular reactor with an internal diameter of 27 mm. The 1,3-PDA was pumped out of the steel vessel together with 50 l (stp) of hydrogen over a fixed-bed catalyst made of Ni/Co which was supported on $ZrO_2$ and which was located in the tubular reactor. The reaction temperature was 160° C. At the top of the tubular reactor, gas and liquid phase were separated and the liquid fraction was returned to the steel vessel. From there, it was pumped again over the catalyst. The reaction was carried out for 150 minutes. This gave L-PPI.2, the properties of which are listed in table 1.

I.1.3 Preparation of Linear Polypropyleneimine L-PPI.3

The reaction from 1.1.2 was repeated, but only over a period of 90 minutes. This gave L-PPI.3.

I.1.4 Preparation of Linear Polypropyleneimine L-PPI.4

1,3-PDA, together with 10 liters (stp)/h of hydrogen were passed continuously through a tubular reactor with an internal diameter of 27 mm over a cobalt fixed-bed catalyst. The total pressure was 50 bar, the temperature 170° C. The feed of 1,3-PDA was 0.8 $kg/l_{cat}\cdot h$. This gave a crude product. Unreacted 1,3-PDA and the corresponding dimer and trimer were distilled off from the crude product, giving L-PPI.4 as a colorless liquid.

I.1.5 Preparation of Linear Polypropyleneimine L-PPI.5

1,3-PDA, together with 10 liters (stp)/h of hydrogen were passed continuously through a tubular reactor with an internal diameter of 27 mm over a cobalt fixed-bed catalyst. The total pressure was 50 bar, the temperature 160° C. The feed of 1,3-PDA was 0.8 kg/$l_{cat}$·h. This gave a crude product. Unreacted 1,3-PDA and the corresponding dimer and trimer were distilled off from the crude product, giving L-PPI.5 as a colorless liquid.

I.1.6 Preparation of Linear Polypropyleneimine L-PPI.6

1,3-PDA, together with 10 liters (stp)/h of hydrogen were passed continuously through a tubular reactor with an internal diameter of 27 mm over a cobalt fixed-bed catalyst. The total pressure was 50 bar, the temperature 160° C. The feed of 1,3-PDA was 0.6 kg/$l_{cat}$·h. This gave a crude product which, according to gas chromatography, had 7% by weight of unreacted 1,3-PDA.

1,3-PDA and the corresponding dimer and trimer were distilled off, giving L-PPI.6 as a colorless liquid.

$M_n$: 302 g/mol, $M_w$: 533 g/mol: $M_w/M_n$ of 1.8.

TABLE 1

Linear polypropyleneimines and their properties

| No. | PAV | SAV | PAV/SAV | $M_n$ [g/mol] | $M_w/M_n$ |
|---|---|---|---|---|---|
| L-PPI.1 | 129 | 923 | 1:7.15 | 872 | 3.4 |
| L-PPI.2 | 228 | 826 | 1:3.6 | 474 | 3.4 |
| L-PPI.3 | 228 | 482 | 1:2.1 | 300 | 2.5 |
| L-PPI.4 | 203 | 816 | 1:4.0 | 525 | 1.6 |
| L-PPI.5 | 269 | 786 | 1:2.9 | 409 | 2.3 |
| L-PPI.6 | 206 | 841 | 1:4.1 | 302 | 1.8 |

Primary and secondary amine values are given in mg KOH/g.

PAV: Primary amine value

SAV: Secondary amine value

I.2 Alkoxylation of Polypropyleneimine

I.2.1 Alkoxylation with an EO/NH Molar Ratio of 1:1

286.3 g of polypropyleneimine L-PPI.1 (tert amine value: 22.1 mg KOH/g) and 14.3 g of water are introduced into a 2 liter autoclave. The autoclave was flushed three times with nitrogen and then heated to 110° C. Over the course of 2 hours, 265.2 g of ethylene oxide were added. In order to complete the reaction, stirring was carried out over a period of 3 hours at 110° C. Then, water and remaining volatile compounds, if present, were removed in vacuo (10 mbar) at 90° C. This gave alkoxylated polypropyleneimine (B.1) according to the invention as a highly viscous yellow oil (522 g).

I.2.2 Alkoxylation with an EO/NH Molar Ratio of 10:1

75.9 g of (B.1) and 2.6 g of KOH pellets (water content: 50% by weight) are introduced into a 2 liter autoclave. The mixture was heated to 120° C. with stirring and under reduced pressure (10 mbar) and stirred for 2 hours in order to remove the water. The autoclave was then flushed three times with nitrogen and then heated to 140° C. (1 bar). Over the course of 2 hours, 332.8 g of ethylene oxide were added. In order to complete the reaction, the mixture was stirred at 140° C. over a period of 3 hours. Then, water and remaining volatile compounds, if present, were removed in vacuo (10 mbar) at 90° C. This gave alkoxylated polypropyleneimine (B.2) according to the invention as a yellow wax-like solid (399.5 g).

I.2.3 Alkoxylation with an EO/NH Molar Ratio of 20:1

64.0 g of (B.1) and 2.6 g of KOH pellets (water content: 50% by weight) are introduced into a 2 liter autoclave. The mixture was heated to 120° C. with stirring and under reduced pressure (10 mbar) and stirred for 2 hours in order to remove the water. The autoclave was then flushed three times with nitrogen and then heated to 140° C. (1 bar). Over the course of 4 hours, 584.7 g of ethylene oxide were added. In order to complete the reaction, the mixture was stirred at 140° C. over a period of 3 hours. Then, water and remaining volatile compounds, if present, were removed in vacuo (10 mbar) at 90° C. This gave alkoxylated polypropyleneimine (B.3) according to the invention as a yellow wax-like solid (630.6 g). Amine value: 57.2 mg KOH/g.

I.2.4 Alkoxylation with an EO/PO/NH Molar Ratio of 10:7:1

225.6 g of (B.2) and 0.8 g of KOH pellets (water content: 50% by weight) are introduced into a 2 liter autoclave. The mixture was heated to 120° C. with stirring and under reduced pressure (10 mbar) and stirred for 2 hours in order to remove the water. The autoclave was then flushed three times with nitrogen and then heated to 140° C. (1 bar). Over the course of 2 hours, 187.9 g of propylene oxide were added. In order to complete the reaction, the mixture was stirred at 140° C. over a period of 3 hours. Then, water and remaining volatile compounds, if present, were removed in vacuo (10 mbar) at 90° C. This gave alkoxylated polypropyleneimine (B.2) according to the invention as a pale yellow wax-like solid (405 g). Amine value: 58.3 mg KOH/g.

I.2.5 Alkoxylation with an EO/PO/NH Molar Ratio of 24:16:1

242.8 g of (B.3) and 1.1 g of KOH pellets (water content: 50% by weight) are introduced into a 2 liter autoclave. The mixture was heated to 120° C. with stirring and under reduced pressure (10 mbar) and stirred for 2 hours in order to remove the water. Then, the autoclave was flushed three times with nitrogen and then heated to 140° C. (1 bar). 46.1 g of ethylene oxide were added and the mixture was left to react for 3 hours with stirring. Then, over the course of 2 hours, 242.9 g of propylene oxide were added. In order to complete the reaction, the mixture was stirred at 140° C. over a period of 3 hours. Then, water and remaining volatile compounds, if present, were removed in vacuo (10 mbar) at 90° C. This gave alkoxylated polypropyleneimine (B.5) according to the invention as a pale brown solid (506 g). Amine value: 28.6 mg KOH/g.

I.2.6 Alkoxylation with an BuO/NH Molar Ratio of 1:1

193.7 g of polypropyleneimine L-PPI.1 and 9.7 g of water are introduced into a 2 liter autoclave. The autoclave was flushed three times with nitrogen and then heated to 110° C. Over the course of 2 hours, 293.6 g of 1,2-butylene oxide were added. In order to complete the reaction, the mixture was stirred at 110° C. over a period of 3 hours. Then, water and remaining volatile compounds, if present, were removed in vacuo (10 mbar) at 90° C. This gave alkoxylated polypropyleneimine (B.6) according to the invention as a highly viscous yellow oil (460 g).

I.2.7 Alkoxylation with an EO/NH Molar Ratio of 4:1

151.8 g of (B.1) and 2.6 g of KOH pellets (water content: 50% by weight) are introduced into a 2 liter autoclave. The mixture was heated to 120° C. with stirring and under reduced pressure (10 mbar) and stirred for 2 hours in order to remove the water. Then, the autoclave was flushed three times with nitrogen and then heated to 140° C. (1 bar). Over the course of 2 hours, 265.6 g of ethylene oxide were added. In order to complete the reaction, the mixture was stirred at 140° C. over a period of 3 hours. Then, water and remaining volatile compounds, if present, were removed in vacuo (10 mbar) at 90° C. This gave alkoxylated polypropyleneimine (B.7) according to the invention as a yellow wax-like solid.

I.2.8 Alkoxylation with an EO/NH Molar Ratio of 7:1

151.8 g of (B.1) and 2.6 g of KOH pellets (water content: 50% by weight) are introduced into a 2 liter autoclave. The mixture was heated to 120° C. with stirring and under reduced pressure (10 mbar) and stirred for 2 hours in order to remove the water. Then, the autoclave was flushed three times with nitrogen and then heated to 140° C. (1 bar). Over the course of 2 hours, 463.8 g of ethylene oxide were added. In order to complete the reaction, the mixture was stirred at 140° C. over a period of 3 hours. Then, water and remaining volatile compounds, if present, were removed in vacuo (10 mbar) at 90° C. This gave alkoxylated polypropyleneimine (B.8) according to the invention as a yellow solid.

Taking the linear polypropyleneimine L-PPI.4 instead of L-PPI.1 and reacting it with corresponding amounts of ethylene oxide gives the alkoxylated polypropyleneimines M-PPI.4-1 to M-PPI.4-3 according to the invention.

II. Preparation of Formulations According to the Invention

The charge density of modified polypropyleneimines (B) was always determined as follows (see also: Horn, Prog. Colloid & Polym. Sci. 1978, 65, 251):

1 g of the modified polypropyleneimine (B) in question was dissolved in 100 ml of demineralized water. A buffer solution and aqueous HCl were used to establish a pH of 4.0, determined potentiometrically. Three ml of an aqueous solution of toluidine blue (50 mg/l of water) were added, and N/400-KPVS (potassium polyvinyl sulfate) solution (Wako) with a concentration of 0.0004 meq/ml was titrated until the color changed from blue to pink. The charge density was calculated as follows:

$$LA=0.4\cdot KV$$

LA: Charge density of the modified polypropyleneimine (B) in question, meq/g (milliequivalent/g)

KV: Consumption of the N/400-KPVS solution [ml]

II.1 Preparation of Base Mixtures

Firstly, base mixtures were prepared from the feed materials according to table 2. The feed materials were mixed dry.

TABLE 2

Base mixtures for experiments with formulations according to the invention and comparison formulations

| | Base-1 | Base-2 | Base-3 |
|---|---|---|---|
| Protease | 2.5 | 2.5 | 2.5 |
| Amylase | 1 | 1 | 1 |
| n-$C_{18}H_{37}(OCH_2CH_2)_9OH$ | 5 | 5 | 5 |
| Polyacrylic acid $M_w$ 4000 g/mol, as sodium salt, completely neutralized | 10 | 10 | 10 |
| Sodium percarbonate (D.1) | 10.5 | 10.5 | 10.5 |
| TAED | 4 | 4 | 4 |
| $Na_2Si_2O_5$ | 2 | 2 | 2 |
| $Na_2CO_3$ | 19.5 | 19.5 | 19.5 |
| Sodium citrate dihydrate (C.1) | 5 | 22.5 | 30 |

All data in g.(C.1) is determined as anhydrous sodium citrate.
Abbreviations:
MGDA: Methylglycineediacetic acid as trisodium salt
TAED: N,N,N',N'-Tetraacetylethylenediamine II.2 Preparation of Formulations According to the Invention II.2.1 Preparation of the Formulations 2 to 8 According to the Invention and of the Comparison Formulations V1

Polypropyleneimines (B) and modified polypropyleneimines (B) according to table 3 were used.

TABLE 3

Modified polypropyleneimines

| Abbreviation | $M_n$ (g/mol) | Alkoxylation of the relevant polypropyleneimine with |
|---|---|---|
| L-PPI.1 | 872 | — |
| L-PPI.4 | 525 | — |
| (B.1) | 1603 | Ethylene oxide (1 EO/NH) |
| (B.7) | 3500 | Ethylene oxide (4 EO/NH) |
| (B.8) | 5200 | Ethylene oxide (7 EO/NH) |
| M-PPI.4-1 | 1510 | Ethylene oxide (1 EO/NH) |
| M-PPI.4-2 | 3330 | Ethylene oxide (4 EO/NH) |
| M-PPI.4-3 | 5100 | Ethylene oxide (7 EO/NH) |

Procedure:

20 ml of distilled water was placed in a 100 ml beaker and modified polypropyleneimine (B) or polypropyleneimine (B) according to tables 3 and 4 was added with stirring.

Stirring was then carried out for 10 minutes. MGDA trisodium salt (A.1), dissolved in 30 ml of water, was then added as per table 3. This gave a clearly transparent solution. Base mixture as per table 3 was then added, the mixture was stirred again, and the water was evaporated.

If, in the test, the corresponding fractions of base mixture are metered in separately from aqueous solution of (A.1), (B), sodium citrate (C.1) or (D.1), the same results are obtained as when the dried formulation was tested with identical amounts of active ingredient. The order of the metered addition is therefore of no consequence.

III. Use of Formulations According to the Invention and Comparison Formulations for the Machine Cleaning of Glasses General: It was ensured that after the first cleaning of the test bodies in the domestic dishwasher until after the weighing and visual inspection of the glasses, the test bodies were handled only with clean cotton gloves so that the weight and/or the visual impression of the test bodies was not falsified.

The testing of formulations according to the invention and comparison formulations was carried out as follows.

III.1 Test Method for Dishwasher with Continuous Operation

Dishwasher: Miele G 1222 SCL

Program: 65° C. (with prewash)

Ware: 3 "GILDE" champagne glasses, 3 "INTERMEZZO" brandy glasses

For the cleaning, the glasses were arranged in the upper crockery basket of the dishwasher. The dishwashing detergent used was in each case 25 g of formulation according to the invention or 25 g of comparison formulation according to table 4, table 4 specifying in each case individually the active components (A.1), base mixture and (B) of formulation according to the invention. The water hardness was in each case in the range from zero to 2° German hardness. Washing was carried out in each case for 100 wash cycles, i.e. the program was left to run 100×. Evaluation was carried out gravimetrically and visually after 100 wash cycles.

The weight of the glasses was determined before the start of the first wash cycle and after drying after the last wash cycle. The weight loss is the difference in the two values.

Besides the gravimetric evaluation, a visual assessment of the ware after 100 cycles in a darkened chamber with light behind a perforated plate was carried out using a grading scale from 1 (very poor) to 5 (very good). In this connection, grades were awarded in each case for patchy corrosion/clouding and/or line corrosion.

Experimental Procedure:

Firstly, for the purposes of pretreatment, the test bodies were washed in a domestic dishwasher (Bosch SGS5602) with 1 g of surfactant (n-$C_{18}H_{37}(OCH_2CH_2)_{10}OH$) and 20 g of citric acid in order to remove any soilings. The test bodies were dried, their weight was determined and they were fixed to the grid base insert.

To assess the gravimetric abrasion, the dry test bodies were weighed. The visual assessment of the test bodies was then made. For this, the surface of the test bodies was assessed with regard to line corrosion (score lines) and clouding corrosion (patchy clouding).

The assessments were carried out according to the following scheme.

Line Corrosion:

L5: no lines evident

L4: slight line formation in a very few areas, fine line corrosion

L3: line corrosion in some areas

L2: line corrosion in a number of areas

L1: pronounced line corrosion

Glass Clouding

L5: no clouding evident

L4: slight clouding in a very few areas

L3: clouding in some areas

L2: clouding in a number of areas

L1: pronounced clouding over virtually the entire glass surface

In the case of the inspection, interim grades (e.g. L3-4) were also allowed.

If water with 2° German hardness was used for the tests, then formulations according to the invention were likewise always superior to the corresponding comparison formulations as far as inhibiting the glass corrosion is concerned.

III.2 Results

The results are summarized in table 4.

TABLE 4

Results of the test with dishwasher (continuous operation)

| Example No. | Base mixture: [g] | (A.1) [g] | (B) [mg] | Weight loss champagne glass [mg] | Weight loss brandy glass [mg] | Visual assessment champagne glass | Visual assessment brandy glass |
|---|---|---|---|---|---|---|---|
| V-1 | Base-3: 17 | 3 | — | 42.6 | 22.7 | L1-2, T1-2 | L2, T2 |
| 2 | Base-3: 17 | 3 | 12 (L-PPI.1) | 10 | 8 | L4-5, T5 | L5, T5 |
| 3 | Base-3: 17 | 3 | 12 (L-PPI.4) | 14 | 11 | L4, T4-5 | L4-5, T4-5 |
| 4 | Base-3: 17 | 3 | 6 (L-PPI.1) | 10 | 9 | L4, T5 | L4-5, T5 |
| 5 | Base-3: 17 | 3 | 12 (B.7) | 18 | 13 | L3, T4 | L3, T4 |
| 6 | Base-3: 17 | 3 | 12 (B.1) | 15 | 13 | L3-4, T4 | L4, T4 |
| 7 | Base-2: 17 | 3 | 24 (B.1) | 14 | 12 | L3-4, T4-5 | L4, T4-5 |

When using formulations according to the invention, only slight or even no glass corrosion was always found.

The invention claimed is:

1. A formulation comprising (A) at least one aminocarboxylate selected from methylglycin diacetate (MGDA), iminodisuccinic acid (IDA) and glutamic acid diacetate (GLDA), and salts thereof, wherein the total aminocarboxylate ranges from 1 to 50% by weight based on the solids content of the formulation, (B) at least one polypropyleneimine which is optionally alkoxylated, wherein the total polypropyleneimine ranges from 0.02 to 0.5% by weight based on the solids content of the formulation.

2. The formulation according to claim 1, which is free from phosphates and polyphosphates.

3. The formulation according to claim 1, wherein polypropylenimine (B) is selected from polypropyleneimines which have been reacted with ethylene oxide or propylene oxide.

4. The formulation according to claim 1, which comprises at least one zinc salt.

5. The formulation according to claim 4, which has, apart from zinc, a heavy metal content below 0.05 ppm, based on the solids content of the formulation in question.

6. The formulation according to claim 1, wherein polypropyleneimine (B) is selected from linear polypropyleneimines which is optionally alkoxylated.

7. The formulation according to claim 1, which comprises in the range from 0.1 to 10% by weight of water.

8. The formulation according to claim 1, wherein the polypropyleneimine (B) is alkoxylated, and the molar ratio of nitrogen atoms to alkylene oxide groups in alkoxylated polypropylenimine (B) is in the range from 1:1 to 1:15.

9. The formulation according to claim 1, which comprises:

in total in the range from 10 to 25% by weight of aminocarboxylate (A), based on the solids content of the formulation.

10. A method comprising washing dishes and/or kitchen utensils with a formulation according to claim 1, where washing is carried out with water of hardness from 2 to 25° German hardness.

11. The method according to claim 10, wherein the washing is carried out in a dishwasher.

12. The method according to claim 10, wherein said dishes and/or kitchen utensils are drinking glasses, glass vases and/or glass vessels for cooking.

13. A method comprising washing an objects which has at least one surface made of glass, which may be decorated or undecorated, with a formulation according to claim 1.

14. A process for producing formulations according to claim 1, wherein (A) aminocarboxylate selected from methylglycin diacetate (MGDA), iminodisuccinic acid (IDA) and glutamic acid diacetahte (GLDA), and salts thereof, and (B) at least one polypropyleneimine which is optionally alkoxylated, and optionally further components are mixed in one or more steps with one another in the presence of water and then the water is completely or partially removed.

15. The process according to claim 14, wherein the water is removed by spray-drying or spray-granulation.

* * * * *